US007905488B2

(12) United States Patent
Fulgham

(10) Patent No.: US 7,905,488 B2
(45) Date of Patent: Mar. 15, 2011

(54) TARGET GAME

(76) Inventor: Jake A. Fulgham, Glenwood Springs, CO (US)

( * ) Notice: Subject to any disclaimer, the term of this patent is extended or adjusted under 35 U.S.C. 154(b) by 907 days.

(21) Appl. No.: 11/676,402

(22) Filed: Feb. 19, 2007

(65) Prior Publication Data

US 2008/0197574 A1 Aug. 21, 2008

(51) Int. Cl.

| | |
|---|---|
| ***A63B 63/00*** | (2006.01) |
| ***A63B 65/02*** | (2006.01) |
| ***F41J 11/00*** | (2009.01) |
| ***F41J 5/052*** | (2009.01) |
| ***A63F 7/20*** | (2006.01) |

(52) U.S. Cl. ..... 273/317; 273/348; 273/371; 463/7; 463/30

(58) Field of Classification Search ..... 463/2, 7, 463/30, 53–54, 56–57

See application file for complete search history.

(56) References Cited

U.S. PATENT DOCUMENTS

| | | | | |
|---|---|---|---|---|
| 3,578,327 | A | 5/1971 | Pickell et al. | |
| 4,199,141 | A | 4/1980 | Garcia | |
| 4,216,968 | A * | 8/1980 | Yeeda | 273/376 |
| 4,333,657 | A | 6/1982 | Jaworski et al. | |
| 5,046,729 | A | 9/1991 | Yancey | |
| 5,286,033 | A | 2/1994 | Wayne | |
| 5,358,253 | A | 10/1994 | Chen | |
| 5,718,433 | A | 2/1998 | Lu et al. | |
| 6,053,910 | A * | 4/2000 | Fleenor | 606/32 |
| 6,147,759 | A * | 11/2000 | Simmons et al. | 356/623 |
| 6,758,772 | B1 | 7/2004 | Chambers et al. | |
| 6,837,495 | B2 | 1/2005 | Gerson et al. | |
| 2003/0169234 | A1 * | 9/2003 | Kempisty | 345/158 |
| 2007/0205775 | A1 * | 9/2007 | Voelkel et al. | 324/662 |

FOREIGN PATENT DOCUMENTS

WO WO 2005100924 A1 * 10/2005

* cited by examiner

*Primary Examiner* — David L Lewis
*Assistant Examiner* — Werner Garner
(74) *Attorney, Agent, or Firm* — Dale J. Ream

(57) ABSTRACT

A target game includes a target area having first and second electrical grids that are configured to maintain a predetermined spacing therebetween. The target game includes a processor in communication with a power supply and grids so as to actuate the power supply to impart a level of capacitance between the grids, to measure an amount of time required for the level of capacitance between the grids to be discharged, and to detect a change in the amount of time required for the level of capacitance to be discharged. The game includes at least one dart having a conductive front portion sized to span the predetermined spacing between the grids. An output device is in data communication with the processor for conveying the detection of a change in an amount of time required for the level of capacitance between the grids to be discharged.

4 Claims, 5 Drawing Sheets

TARGET GAME

BACKGROUND OF THE INVENTION

This invention relates generally to games and, more particularly, to a target game played on a lawn in which players toss darts having electrically conductive portions at a target having electrical grids for sensing a position of impact.

The traditional game of lawn darts was enjoyed by families for many years. In this game, darts were tossed at a target that laid flat on the grass and the darts had a pointed tip that would penetrate the ground and thus indicate the position of the dart relative to the target. While this game was entertaining, it was seen by many as being unacceptably dangerous in that the pointed metal tip of each dart—which was capable of penetrating the ground—was a danger to children who may be inadvertently struck by it.

Various electronic target games and, more particularly, dart-related games have been proposed in the art. Although assumably effective for their intended purposes, these target games do not provide a game for play upon a lawn in which darts may be tossed upon a target and a position of impact detected electronically.

Therefore, it would be desirable to have a target game in which darts having electrically conductive portions may be tossed at a target having electrical grids for sensing a position of impact. Further, it would be desirable to have a target game in which determines and records the position of a dart tossed upon a target by sensing changes in electrical capacitance within concentric electrical grids. In addition, it would be desirable to have a target game that is safe for children and adult players.

SUMMARY OF THE INVENTION

A target game according to the present invention includes a target area having a first electrical grid and a second electrical grid, the first grid being separate from and out of contact with said second grid. The first and second grids are configured to maintain a predetermined spacing therebetween. The target game also includes a processor in communication with a power supply and the first and second grids so as to actuate the power supply to impart a level of capacitance between the first and second grids, to measure an amount of time required for the level of capacitance between the first and second grids to be discharged, and to detect a change in the amount of time required for the level of capacitance between the first and second grids to be discharged.

The game further includes at least one dart having a conductive front portion sized to span the predetermined spacing between the first and second grids. An output device is in data communication with the processor for conveying the detection of a change in an amount of time required for the level of capacitance between the first and second grids to be discharged. It is understood that the target area may include more than one target area, such as an outer area, an inner area, and perhaps even another inner area. Each target area may function as described previously although each may be associated with different point values, sounds, etc.

Therefore, a general object of this invention is to provide a target game, for tossing darts at a target area spread out upon a lawn.

Another object of this invention is to provide a target game, as aforesaid, in which the target area is capable of sensing a location of an impact by a dart.

Still another object of this invention is to provide a target game, as aforesaid, that includes darts that do not penetrate the ground and are safe even if they contact a person.

Yet another object of this invention is to provide a target game, as aforesaid, that determines a dart's general position of impact on the target by measuring an amount of time required for a level of capacitance between the first and second grids to be discharged.

A further object of this invention is to provide a target game, as aforesaid, that provides a plurality of light or sound effects corresponding to respective positions of impact by darts upon the target area.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A target game 100 according to the present invention will now be described in detail with reference to FIGS. 1 through 5 of the accompanying drawings. More particularly, a target game 100 (also referred to herein as a dart game and a lawn dart game) according to the current invention includes a target 110 and at least one dart 150.

Figure 1:
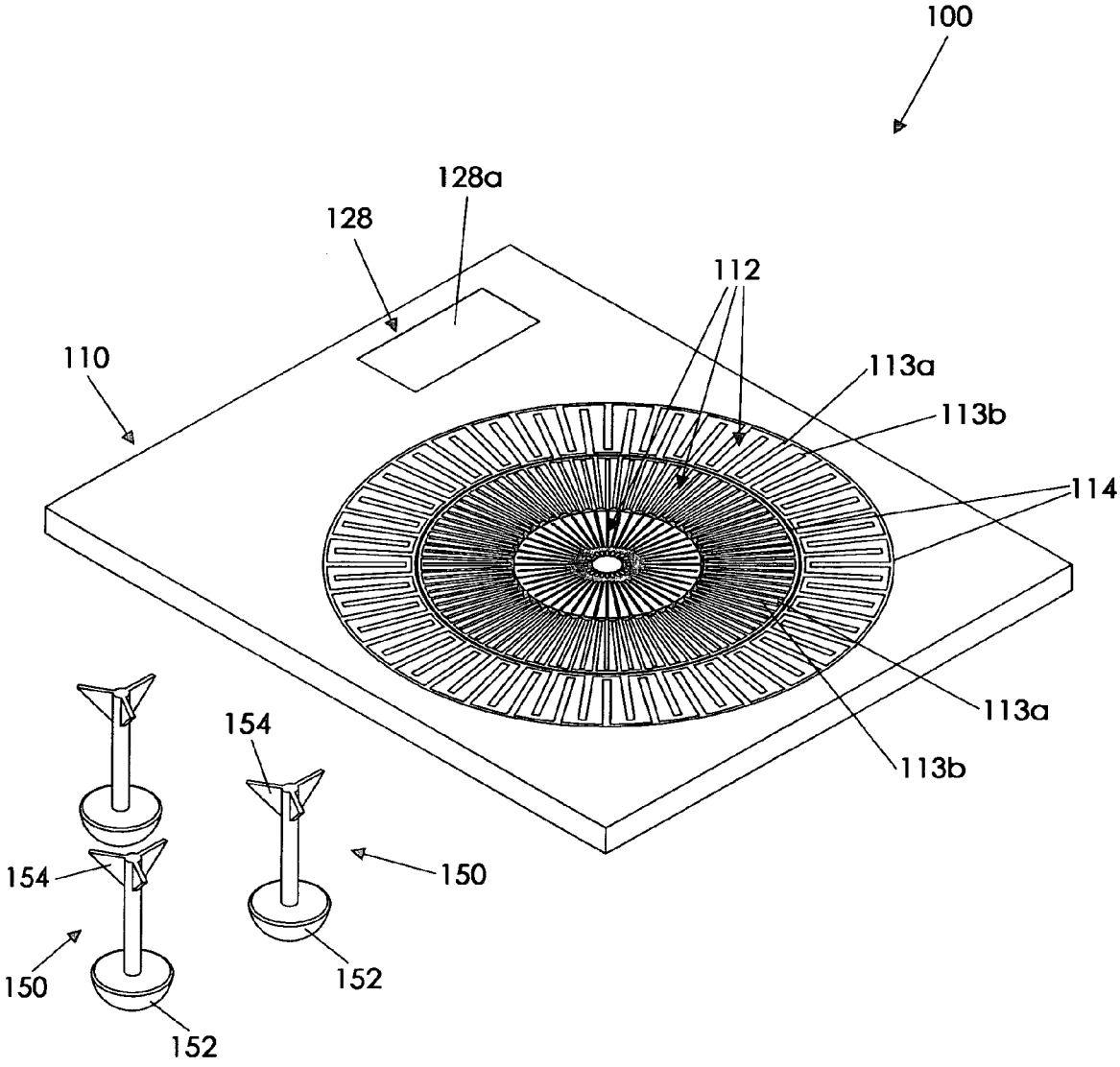
FIG. 1 is a perspective view of a target game according to a preferred embodiment of the present invention.
Figure 2:
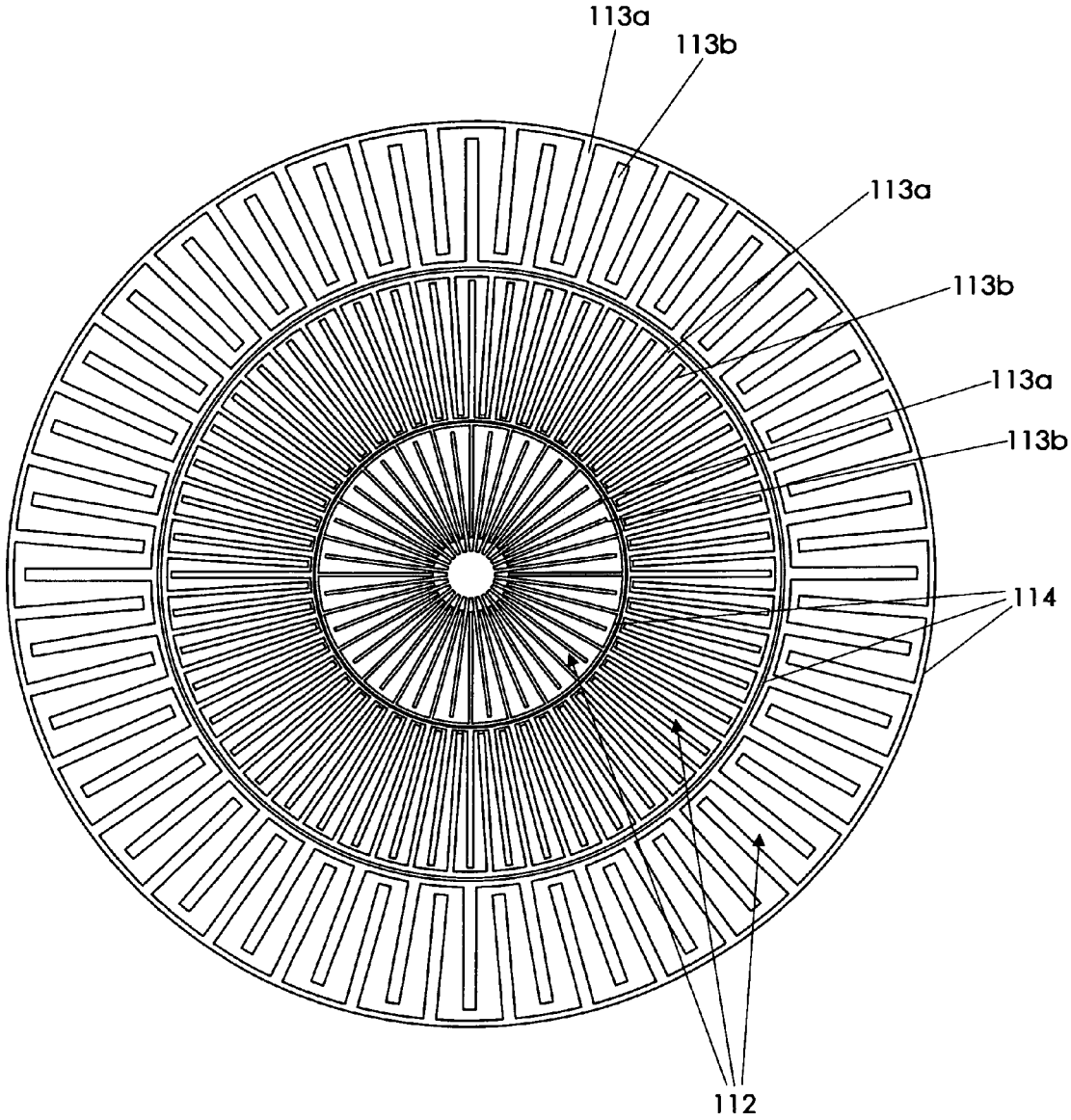
FIG. 2 is a plan view of a target area of the target game as in FIG. 1.

The target 110 has at least one target area 112. The embodiments shown in FIGS. 1 and 2, for example, have three target areas 112. Any target area 112 that is outside another target area 112 may be referred to herein as an outer target area, and any target area 112 that is inside another target area 112 may be referred to herein as an inner target area. Each target area 112 has a set of first and second electrical grids 113*a*, 113*b*. The respective electrical grids 113*a*, 113*b* are separate from and out of contact with one another. In addition, the first and second grids 113*a*, 113*b* may be configured to maintain a predetermined spacing between the first and second grids 113*a*, 113*b*. In other words, the grids 113*a*, 113*b* may be shaped, sized, or arranged so that gaps between the grids 113*a*, 113*b* that are larger than a predetermined size do not exist. One or more of the target areas 112 may be defined by substantially concentric circles 114, and the first and second grids 113*a*, 113*b* may collectively define a radially alternating pattern, as shown in FIGS. 1 and 2.

Figure 5:
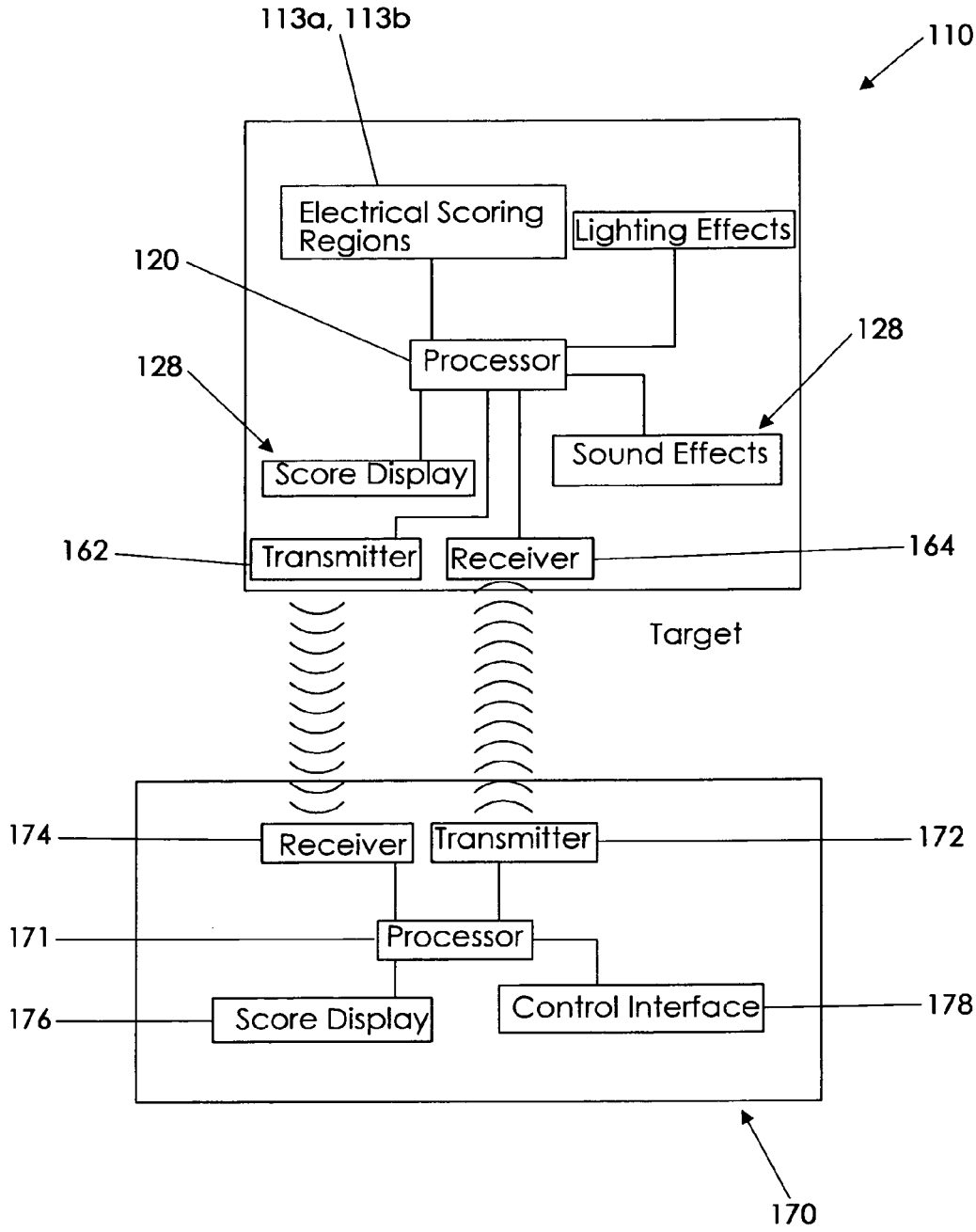
FIG. 5 is a block diagram of the electronic components of the target game as in FIG. 1.

The target may further include or be otherwise associated with a processor 120, a power supply 125 (e.g., a battery, AC power, etc.), and/or an output device 128. The processor 120 may be in data communication with the power supply 125, the grids 113*a*, 113*b*, and/or the output device 128 (FIG. 5). The processor 120 may include programming (e.g., software or hardware) to actuate the power supply 125 to impart a level of capacitance between respective first and second grids 113*a*, 113*b*, programming to measure an amount of time required for the level of capacitance to be discharged, and programming to detect any change in the amount of time required for the level of capacitance to be discharged (as shown in FIG. 3*b*, for example). The amount of time required for the level of capacitance to be discharged should remain relatively constant until the capacitance of the circuit changes. The processor 120 may additionally include programming to actuate the output device 128 to announce a detected change in the amount of time required for the level of capacitance to be discharged. The output device 128 may include, for example, a visual display 128*a* (FIGS. 1 and 5) and/or an audible alarm (FIG. 5). The audible alarm may, for example, include battlefield sounds such as bombs exploding or announcing a "hit." Different sounds associated with different regions of the target area would enable users to immediately know where their dart hit.

Figure 4:
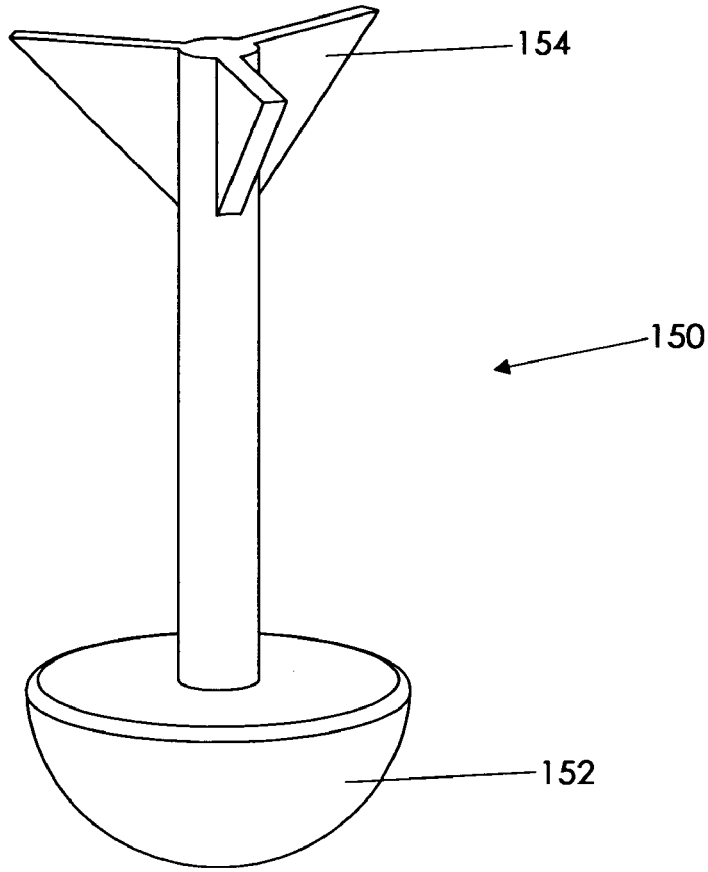
FIG. 4 is a perspective view of a dart of the target game as in FIG. 1.

Each dart 150 has a conductive front portion 152 sized to span the predetermined spacing between the respective first and second grids 113*a*, 113*b*. In other words, the front portion 152 is large enough to contact a first grid 113*a* and also a second grid 113*b* every time it enters a respective target area 112. The front portion 152 may have a blunt (e.g., rounded or flattened) configuration for safety concerns. To provide conductivity, the front portion 152 may be constructed of metal and/or other appropriate materials, such as carbon impregnated silicon based rubber. Each dart 150 may further include stabilizing members 154 as shown in FIG. 4.

As shown in FIG. 5, a target transmitter 162 and/or a target receiver 164 may be in data communication with the processor 120. A remote control device 170 may have a remote control processor 171, a remote control transmitter 172, a remote control receiver 174, a remote control display 176, and/or a remote control user input device 178. The remote control processor 171 may be in data communication with the remote control transmitter 172, the remote control receiver 174, the remote control display 176, and the remote control user input device 178. The remote control display 176 may include, for example, a visual display and/or an audible alarm.

Figure 3A:
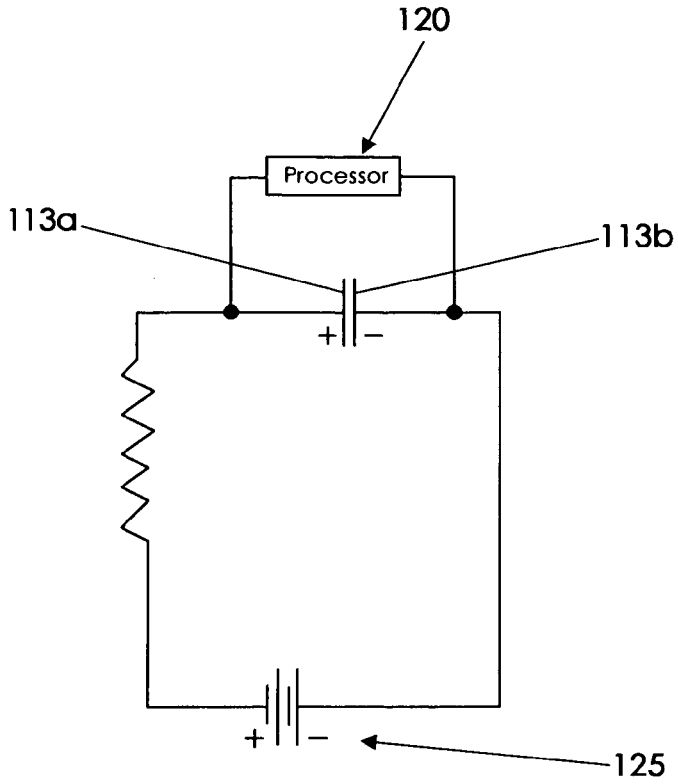
FIG. 3*a* is a schematic diagram of the sensing circuitry of the target game as in FIG. 1.
Figure 3B:
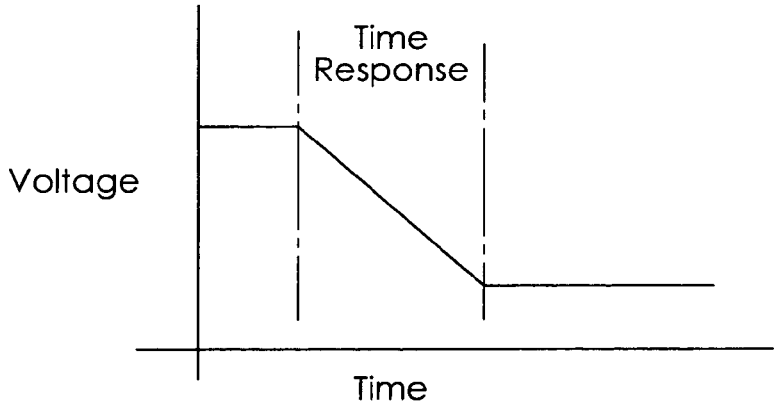
FIG. 3*b* is an illustration of the processor measuring the time for a level of capacitance to be discharged for detecting a change in capacitance.

In use, as shown in FIG. 3*a*, the processor 120 may cause the power supply 125 to impart a voltage across the grid(s) 113*a*, 113*b* to provide a level of capacitance. The processor 120 may then measure the amount of time required for the level of capacitance to be discharged (FIG. 3*b*) as discussed above, and the processor 120 may detect any change in the amount of time required for the level of capacitance to be discharged (as discussed above). A change in the level of capacitance may signify that a dart 150 has touched a respective first and second grid 113*a*, 113*b*. The processor 120 may then cause the output device 128 to convey a predetermined value (i.e., a "score") that is associated with the appropriate target area 112. If desired, the processor 120 may additionally keep a record of earlier instances of capacitance change (i.e., earlier "scores") to provide a total score via the output device 128.

The remote control processor 171 may cause the remote control transmitter 172 to transmit data input through the remote control user input device 178 to the target receiver 164, which may then be used by the processor 120 to perform various functions (e.g., functions related to scoring or the output device 128). The processor 120 may cause the target transmitter 162 to transmit data (e.g., score data) to the remote control receiver 174, which may then be used by the remote control processor 171 to perform various functions (e.g., functions related to scoring or the remote control display 176.

It is understood that while certain forms of this invention have been illustrated and described, it is not limited thereto except insofar as such limitations are included in the following claims and allowable functional equivalents thereof.

The invention claimed is:

1. A lawn dart game, comprising:

a target having a plurality of target areas and a processor, each target area having a set of first and second electrical grids, each first grid being separate from and out of contact with each second grid;

wherein said first and second grids collectively define a radially alternating configuration;

a power supply;

a dart having a conductive front portion sized to span between respective first and second grids, said dart front portion having a blunt configuration; and an output device;

wherein said processor is in data communication with said power supply, each said grid, and said output device;

wherein said processor includes programming to actuate said power supply to impart a level of capacitance between respective first and second grids;

wherein said processor includes programming to measure amount of time required for said level of capacitance between said first and second grids of each said set to be respectively discharged;

wherein said processor includes programming to detect any change in said amount of time required for said level of capacitance between respective first and second grids to be discharged;

wherein said processor includes programming to actuate said output device to announce a detected change in amount of time required for said level of capacitance between any said first and second grids to be discharged;

a target transmitter in data communication with said processor;

a remote control device having a remote control processor, a remote control receiver for receiving data from said target transmitter, and a remote control display;

said remote control processor being in data communication with said remote control receiver and said remote control display;

a target receiver in data communication with said processor;

wherein said remote control device includes a user input device and a remote control transmitter for sending data to said target receiver, said remote control processor being in data communication with said remote control transmitter and said user input device;

wherein at least one said target area is defined by substantially concentric circles; and wherein said first and second grids of each respective set are configured to maintain a predetermined spacing between said first and second grids.

2. The lawn dart game as in claim 1, wherein said output device includes at least one of a visual display or an audible alarm.

3. The lawn dart game as in claim 1, wherein said remote control display includes at least one of a visual display or an audible alarm.

4. The lawn dart game as in claim 1, wherein said dart front portion includes carbon impregnated silicon based rubber.

* * * * *